US007032674B2

(12) United States Patent
Nicholson

(10) Patent No.: US 7,032,674 B2
(45) Date of Patent: Apr. 25, 2006

(54) PROCESS FOR INCREASING FLOW CAPACITY OF GAS WELLS

(76) Inventor: A. Kirby Nicholson, Box 7, Site 10, R.R.#8, Calgary, Alberta (CA), T2J 2T9

( * ) Notice: Subject to any disclaimer, the term of this patent is extended or adjusted under 35 U.S.C. 154(b) by 96 days.

(21) Appl. No.: 10/622,547

(22) Filed: Jul. 21, 2003

(65) Prior Publication Data

US 2004/0020656 A1 Feb. 5, 2004

Related U.S. Application Data

(60) Provisional application No. 60/399,423, filed on Jul. 31, 2002.

(51) Int. Cl.
*E21B 43/32* (2006.01)
*E21B 37/10* (2006.01)

(52) U.S. Cl. ..... 166/370; 166/311

(58) Field of Classification Search ..... 166/309, 166/311, 369, 370
See application file for complete search history.

(56) References Cited

U.S. PATENT DOCUMENTS

| | | | | | |
|---|---|---|---|---|---|
| 4,090,564 | A | * | 5/1978 | Cook et al. | 166/370 |
| 4,359,092 | A | * | 11/1982 | Jones | 166/265 |
| 5,310,002 | A | * | 5/1994 | Blauch et al. | 166/307 |
| 6,089,322 | A | * | 7/2000 | Kelley et al. | 166/370 |
| 2003/0198562 | A1 | * | 10/2003 | Blauch et al. | 417/423.3 |

* cited by examiner

*Primary Examiner*—Zakiya Walker
(74) *Attorney, Agent, or Firm*—Michael R. Williams; Adrian D. Battison; Ryan W. Dupuis

(57) ABSTRACT

The removal of liquids from the reservoir and/or the fracture-proppant pack of gas wells is described. Water that is trapped by capillary and viscous forces in areas of low velocity are mobilized by the application of an abrupt flowing-pressure reduction or shock. Liquids are then recovered from the wellbore to prevent hydrostatic back-pressure restrictions on the gas well. Flow at the reduced pressure is continued until liquid recovery from the wellbore reaches a minimum. The well is then returned to the normal operating pressure.

9 Claims, 2 Drawing Sheets

Plan View of a Hydraulically-Fractured Gas Well

Figure 1A: Fracture-Stimulated Gas Well Before Process
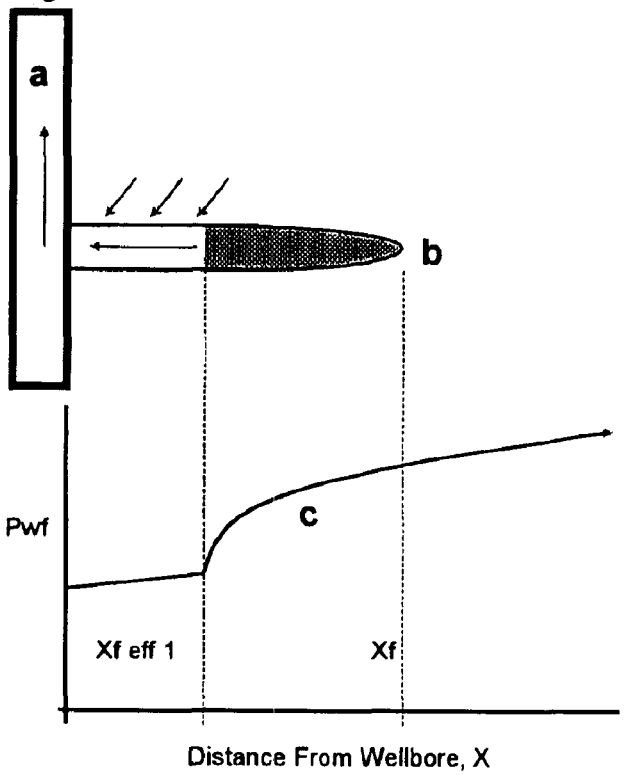
Figure 1B: Well After Process
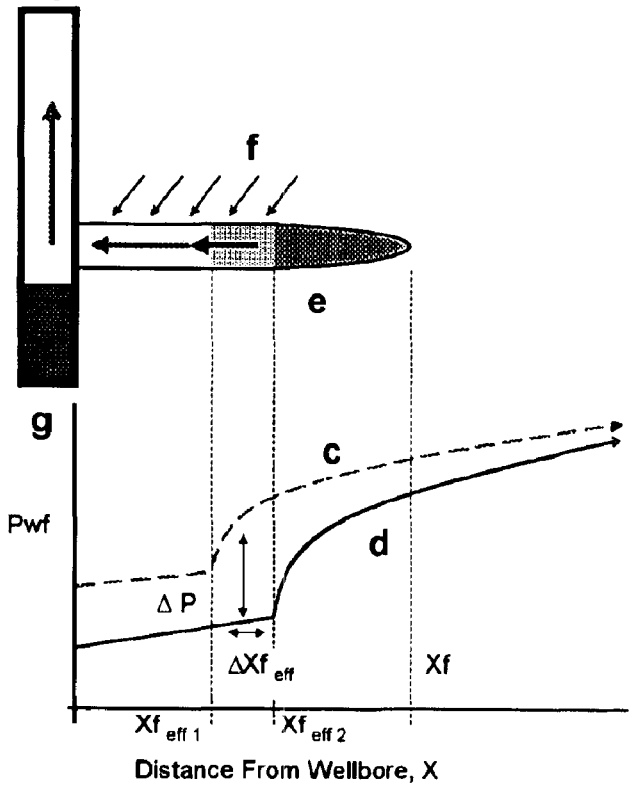

Figure 2: Plan View of a Hydraulically-Fractured Gas Well
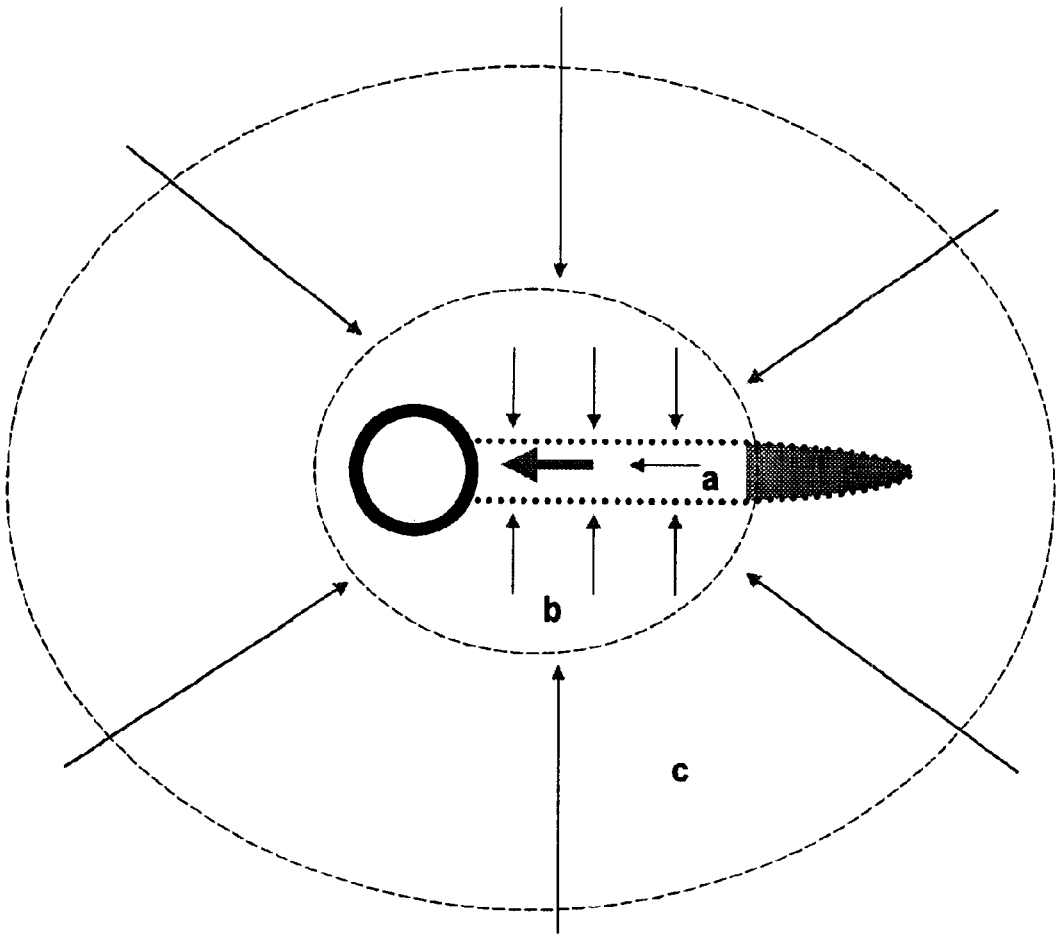

PROCESS FOR INCREASING FLOW CAPACITY OF GAS WELLS

This application claims the benefit of 35 USC § 119(e) to Provisional Patent Application Ser. No. 60/399,423 filed on Jul. 31, 2002.

FIELD OF THE INVENTION

The present invention relates generally to the field of gas-producing wells.

BACKGROUND OF THE INVENTION

The build-up of liquids (most often water) in gas-producing wells is problematic, as the gas must pass through the water to enter the well and flow to surface. This causes the gas production rate to decrease, which eventually results in the gas no longer being capable of carrying entrained water to the surface. Over time, water saturation increases in the area surrounding the wellbore and the water level rises in the wellbore casing and creates back pressure that further restricts gas flow rates. Eventually gas production may cease altogether.

Liquid accumulation requires special attention in wells that have been fracture-stimulated. Specifically, fracture stimulation is used on wells in reservoirs with low permeability to gas near the wellbore. A well is fracture-stimulated by pumping a large amount of sand, transported in a liquid- or gel-carrier, into the formation. The low-permeability rock is fractured and propped open with the fracture sand pack (proppant pack), which has much higher permeability than the surrounding reservoir. The high-permeability fracture extends a distance away from the wellbore, providing a long flow conduit with a high surface area for gas to enter the wellbore. Fracture water, pumped into the reservoir in the form of the sand carrier, is often not fully recovered after the stimulation procedure. This water can create liquid-loading problems for a long period of time and later in a well's life, this water may enter the wellbore where often mistaken for liquids produced from the reservoir and deemed to be a permanent condition that may be associated with higher flow rates. When this occurs, a well is often presumed to be unsalvageable and is capped in preparation for abandonment.

The prior art teaches methods for removing water from the wellbore but does not teach methods for removing water from the reservoir or fracture proppant pack surrounding the wellbore.

Specifically, U.S. Pat. No. 2,061,865 teaches a system for removing water from a gas-producing well. The system relies on a compressor driving air through a Venturi located at the bottom of the tubing, which in turn creates a vacuum for drawing water out of the well casing.

U.S. Pat. No. 4,171,016 teaches a device wherein water is removed once gas pressure drops below a certain level. As the water level rises, a float rises with the water and exposes a number of apertures. Drive water is injected into a chamber, generating a vacuum that causes well water to be drawn into the apertures.

U.S. Pat. No. 5,335,728 teaches a method of vaporizing water drawn off from a gas well into steam.

SUMMARY OF THE INVENTION

According to a first aspect of the invention, there is provided a method of lowering accumulated liquid saturation surrounding the wellbore of a gas well comprising:

providing a gas well having a wellbore, said gas well having accumulated high liquid saturation surrounding the wellbore, said liquid reducing flow rates of the gas;

inducing a rapid decrease in flowing pressure into said gas well, thereby causing liquid surrounding the wellbore to be dislodged; and removing said dislodged liquid from the wellbore.

The dislodged liquid may be removed by swabbing or with coil tubing.

Flowing pressure may be decreased by attaching a compressor to the well, or a group of wells, or by opening the wells, or group of wells, to the atmosphere.

The rapid decrease in pressure and liquid removal may be repeated until no further water accumulates in the wellbore.

One embodiment of the invention will now be described in conjunction with the accompanying drawings.

BRIEF DESCRIPTION OF THE DRAWINGS

FIG. 1A illustrates a hydraulically-fractured gas well with liquids accumulated at the tip of the fracture where gas will not flow. The pressure profile of the well under stable flowing conditions is shown schematically. FIG. 1B illustrates the same well as above with the effect of an abrupt change in flowing pressure. Liquids are discharged from the fracture, having been shocked by an abrupt drop in pressure. The following labels describe the drawings in detail:

a. vertical wellbore flowing gas to surface,
b. Hydraulic fracture with length Xf, liquid-saturated proppant at tip, gas enters and flows to the wellbore within effective length, $Xf_{eff\ 1}$,
c. Chart illustrating flowing gas pressure profile, Pwf, with respect to distance, X, from the wellbore,
d. Abrupt drop in well flowing pressure creates pressure differential within liquid saturated fracture,
e. Pressure differential dislodges liquid, increasing effective length of fracture to $Xf_{eff\ 2}$,
f. The added effective length of the fracture creates more flow area for gas to enter; gas production capability increases,
g. Water dislodged from the fracture may remain in the wellbore until swabbed or otherwise removed.

FIG. 2 illustrates the concept of radial flow and velocity decrease away from the wellbore. Lower velocities are the cause of liquid accumulation. The labels listed below describe the drawing in detail:

a. Nearly-radial reservoir flow towards wellbore,
b. Bi-linear flow near fracture illustrating convergence of flow lines,
c. Fracture flow illustrating increased flow approaching wellbore with addition of gas along the face of the fracture.

The total flow rates entering and leaving areas a, b, and c are all equal, however the velocity of the gas stream increases from a to b and from b to c as the flow area becomes smaller. This illustration outlines how liquids may accumulate away from the wellbore where flow velocity is low. Liquid is shown to saturate the tip of the fracture.

The principles of converging flow and liquid accumulation may also apply to a well that has not been fracture-stimulated.

DESCRIPTION OF THE PREFERRED EMBODIMENTS

As used herein, "the fracture" (noun) refers to the area extending out from perforations in a wellbore that has been hydraulically fractured and often propped open with a high permeability material like sand; (verb) also, "to fracture".

As used herein, "proppant-pack" refers to the high permeability material (usually sand) that is placed in a hydraulically fractured portion of the reservoir to keep the fracture from closing, or healing, after pressure from the fracture operation is reduced.

As used herein, "proppant" refers to material (usually sand) that is used to hold open a hydraulic fracture.

As used herein, "head" refers to pressure resulting from the height of a column of liquid above the point where the pressure is being measured.

As used herein, "coning" refers to an increase in water production from a gas-producing well by means of drawing-up water from a point below the gas formation resulting from a reduction in flowing pressure.

Described herein is a method of reducing accumulated liquid from the area surrounding a gas well for the purpose of increasing the flow capability of the well. The present invention relates to a procedure for the removal of liquid (most often water) from a natural gas-producing reservoir. Herein, the removal of water is described by way of example. It is to be understood that accumulations of other liquids, for example oil or hydrocarbon liquids may also be reduced using the described process. The procedure is particularly effective on, but not limited to, wells that have been fracture-stimulated. Fracture-stimulated wells have more volume in the proppant-pack of the fracture in which water can be stored as a result of the stimulation procedure, or due to accumulation with production of the gas and associated reservoir water. Usually some water is produced with natural gas as most reservoirs contain water in conjunction with the hydrocarbons like natural gas and oil. Following the clean-up process, during which the water is actively removed from the reservoir and wellbore, the gas-producing capability of the well is greatly improved. Specifically, the method for unloading water from the well involves subjecting the well to a rapid decrease in pressure. This in turn causes the water to be dislodged, meaning that the water can now be removed. The process can be repeated as necessary until the water has been substantially removed and/or the flow rates have increased.

Water accumulation inside the wellbore of a gas well is known to be detrimental to the production of gas from a well. Water accumulates in the wellbore when the velocity of the gas production stream in the wellbore is too low to carry water droplets to the surface and out of the well. As water accumulates in a column of liquid in the wellbore, hydro-static pressure (head) increases at the bottom where gas is entering the wellbore from the gas-producing reservoir. Higher bottom-hole-flowing pressures reduce the flow rate of gas from the well. As the gas production rate decreases with water accumulation inside the wellbore, the gas velocity drops and even more water accumulates due to a further reduction in velocity. With enough water accumulation, gas production can cease altogether due to a water column in the wellbore that has enough head to equal the reservoir pressure.

Thus, liquid loading in natural gas wells can be caused by any or all of the following: drilling, completion and/or stimulation techniques; high water saturation levels in the producing reservoir or connected zones; or gradual accumulation in reservoirs with relatively low water-saturation levels but also with low gas velocities, which impedes effective removal of liquids. As will be appreciated by one knowledgeable in the art, this list is by no means exhaustive and is intended for illustrative purposes.

Furthermore, water that accumulates beyond the wellbore in surrounding reservoir rock or in the fracture is usually only considered during the early life of a well, resulting from drilling liquid invasion or liquids introduced during completion operations including fracture stimulation. FIG. 1A illustrates such water accumulation in a gas well fracture proppant-pack. It is common practice to recover as much drilling and completion liquid as possible from regions surrounding the wellbore to enhance flow. However, liquid recovery from the reservoir rock or fracture proppant pack is not often considered during the producing life of the well. It is the opinion of the inventor that accumulated liquids (most often water) in the reservoir or fracture proppant-pack surrounding the wellbore can be highly detrimental to the productive capacity of the well.

A great deal of petroleum industry effort and capital is focused on enhancing production from natural gas wells by reducing the effects of wellbore liquid loading. As North American gas supply becomes more mature, lower quality gas reservoirs are increasingly being developed. These reservoirs often have low permeability and low flow rate capacity resulting in wells that do not have the capability to lift liquids out of the wellbore even at the beginning of their production life.

In addition, gas wells are often produced at flow rates below the capacity of the well, sometimes due to facility or marketing constraints. Also, many wells are restricted from flowing at high rates because high produced-water rates accompany the higher gas rates, creating production problems and requiring extensive water removal. Often, operators believe that the higher water influx seen with lower flowing pressures, and associated higher gas rates, is due to coning of an underlying wet zone or aquifer and so believe the water influx to be a permanent condition associated with higher flow rates.

In most fields where some liquid is produced with the natural gas, production will decline rapidly in low-rate wells without some liquid-removal strategy. Operators frequently employ small-diameter tubing strings (velocity strings), swabbing programs, tubing with plunger lift or simple blow-down techniques that may include foaming agents (soap-sticking). All of these techniques focus on removing liquids specifically from the wellbore where a growing column of liquid (especially water) has an increasing, measurable and detrimental effect on gas production.

However, in many cases, the high rate of water influx that often occurs after reducing flowing pressures in fracture-stimulated gas wells is not a permanent detrimental effect. High liquid rates after a reduction in flowing pressure are commonly caused by the reservoir or fracture discharging some liquid.

Despite the general industry knowledge and capital expended on wellbore liquid management and removal, there are no petroleum industry strategies known in the art for managing liquid accumulations that occur in the near-wellbore reservoir or fracture proppant-pack. Fracture-stimulated wells, in particular, have storage capacity for significant liquid volumes in the proppant pack of the fracture. Wells with large fractures (e.g. 30 Tonnes of sand) may have several cubic meters of pore volume in which liquids may accumulate. Although gas velocity through the high-porosity, high-permeability fracture proppant pack is higher than in the open wellbore (due to the requirement for gas to travel around the individual sand grains), the proppant has some capillary force that may hold liquids in areas where shear forces due to low-flow rates are not sufficient to move liquid droplets.

Liquid hold-up in or around the fracture does not create the hydrostatic effect of liquids in the wellbore, but liquid saturation may increase to the point that the effective permeability of the fracture and its surrounding reservoir rock is degraded. This type of liquid loading can be as detrimental to the productive capability of a gas well as wellbore liquid loading.

Liquid loading in the reservoir or fracture proppant pack, as with wellbore loading, only occurs with gas flow velocities that are too low to carry liquids. The proposed solution to the problem is to increase the velocity of the gas stream. In the wellbore this can be accomplished by reducing the pressure or reducing the cross-sectional area of the flow path (install smaller tubing). In the surrounding reservoir or fracture only velocity increases due to pressure changes are possible. In order to dislodge liquids from a liquid-saturated portion of the fracture or reservoir rock, a pressure differential of sufficient magnitude must be applied across this portion of rock or sand.

When a well is flowing, a pressure gradient is present, as depicted in FIG. 1A. Generally this gradient is gradual and after a well has flowed for some time, the pressure gradient remains nearly static. In areas with very little pressure differential, liquids can be held by capillary or viscous forces in the fracture-sand or reservoir rock where flow velocities are small. This liquid hold-up is more likely to occur farther away from the wellbore, as shown in FIG. 2, because gas flowing towards the wellbore converges, causing the gas velocity to increase in order to accommodate conservation of mass in any given area around the well. Velocity is lower away from the wellbore; hence, liquids are more likely to accumulate away from the wellbore.

Normally, flowing pressures are reduced gradually with operational changes in the pipeline gathering system or as a means to maintain production with a decline in reservoir pressure. Any change in the flowing pressure of a well creates a pressure differential wave that propagates away from the wellbore at a rate that is dependant upon the permeability and porosity of the fracture and/or reservoir and the viscosity and compressibility of the gas. A change in pressure takes time to propagate away from the well to where liquids may be held. A large, abrupt change in flowing pressure creates a more intense pressure wave, or shock, that propagates away from the wellbore into the reservoir. This shock wave provides the means for the removal of some trapped liquids.

The present process comprises a method for increasing the productive capacity of gas wells by removing liquids from the gas reservoir or hydraulic fracture proppant pack in fracture-stimulated wells. Liquids are removed from areas of higher saturation by abruptly reducing the flowing pressure of the well from a stable flowing condition. This abrupt change in pressure creates a shock wave that propagates away from the wellbore, through areas that may contain higher liquid saturation. The shock breaks the capillary bonds and overcomes viscous forces holding liquids in the pores of the reservoir rock or proppant pack and mobilizes the liquid to flow towards the wellbore. FIG. 1B shows the affected area in the fracture proppant pack, $\Delta Xf_{eff}$, resulting from a pressure shock. Liquids are then recovered from the wellbore by swabbing, coil-tubing or other methods. Areas within the reservoir or fracture that are cleared of liquids may then allow gas to pass through. The successful application of this process should increase the productive capacity of the well. Gas flow rates, measured at the same flowing pressure that was in place before application of the process, should be higher.

This process can be performed by whatever means are available to abruptly reduce the current flowing pressure of a well from normal operating flowing pressures to a substantially reduced pressure. Examples of how to achieve this abrupt change in pressure include, but are by no means limited to, the installation of a gas compressor or by diverting normal pipeline gas flow to atmospheric conditions (venting or flaring). The process is most effective with the maximum change in flowing pressure applied in the shortest period of time.

Liquids entering the wellbore must be recovered quickly to prevent a liquid build-up in the wellbore that can cause a hydrostatic pressure increase that counter-acts the abrupt change in pressure. The reduced pressure should be held as long as liquids continue to be recovered from the wellbore. Once liquid production ceases or drops to a normal liquid-gas-ratio, the process is complete.

This process can be repeated as often as needed to remove accumulated liquids or as economics of the process dictate.

The greatest change in flowing pressure applied in the shortest possible time is deemed most effective, however positive results may occur with variations to this process.

In some embodiments, instead of a single large drop in flowing pressure, a series of step changes may be applied.

In some embodiments, instead of an instantaneous (abrupt) drop in flowing pressure, a controlled drop over a period of up to 12 hours may be applied.

It is of note that this process may be applied to a group of wells simultaneously by dropping the pressure at a gathering-system node through which all of the wells flow.

Several benefits can be obtained by removing the accumulated water from the area in and around the fracture. Extension of the effective fracture length can be achieved by removing water from the distant, saturated portion of the fracture. By increasing the effective fracture length, the well increases it's high-permeability access to the producing formation and thereby increases its flow rate capability. If accumulated water is removed from the fracture sand pack and higher gas rates are enabled, the resulting higher gas velocities improve the future ability of the well to carry liquid out of the formation and up the wellbore, thereby reducing the likelihood for continued accumulation of liquid in the fracture sand pack due to low gas velocity.

While the preferred embodiments of the invention have been described above, it will be recognized and understood that various modifications may be made therein, and the appended claims are intended to cover all such modifications which may fall within the spirit and scope of the invention.

What is claimed is:

1. A method of lowering accumulated liquid saturation surrounding the wellbore of a gas well comprising:

providing a gas well having a wellbore, said gas well having accumulated liquid saturation in material surrounding the wellbore, said liquid being spaced from said wellbore and reducing flow rates of flowing gas toward said wellbore;

inducing a rapid decrease in flowing pressure into said gas well to increase velocity of the flowing gas, thereby causing liquid surrounding the wellbore to be dislodged from the material and flow toward said wellbore; and removing said dislodged liquid from the wellbore.

2. The method according to claim 1 wherein the dislodged liquid is removed by swabbing.

3. The method according to claim 1 wherein the dislodged liquid is removed with coil tubing.

4. The method according to claim 1 wherein flowing pressure is decreased by attaching a compressor to a well or group of wells.

5. The method according to claim 1 wherein flowing pressure is decreased by opening the flow a well or group of wells to the atmosphere.

6. The method according to claim 1 wherein the gas well has been fracture stimulated.

7. The method according to claim 1 including repeating the rapid decrease in pressure and liquid removal until no further liquid accumulates in the wellbore.

8. A method according to claim 1 wherein the liquid is hydrocarbon liquids or oil.

9. The method according to claim 1 wherein the liquid is water.

* * * * *